United States Patent [19]

Williams

[11] 4,421,310

[45] Dec. 20, 1983

[54] METHOD AND APPARATUS FOR RANDOMLY POSITIONING INDICA-BEARING MEMBERS

[75] Inventor: David E. Williams, Reno, Nev.

[73] Assignee: Summit Systems, Inc., Canoga Park, Calif.

[21] Appl. No.: 76,147

[22] Filed: Sep. 17, 1979

[51] Int. Cl.[3] ..... A63F 5/04

[52] U.S. Cl. ..... 273/143 R

[58] Field of Search ..... 273/138 A, 143 R, 143 C; 235/92 GA; 364/717; 250/231 SE

[56] References Cited

U.S. PATENT DOCUMENTS

| | | | |
|---|---|---|---|
| 3,751,648 | 8/1973 | Wu | 364/717 |
| 3,866,029 | 2/1975 | Chevalier | 364/717 |
| 4,071,246 | 1/1978 | Hooker | 273/143 R |
| 4,095,795 | 6/1978 | Saxton | 273/143 R |
| 4,099,722 | 7/1978 | Rodesch et al. | 273/143 R |
| 4,238,127 | 12/1980 | Lucero et al. | 273/143 R |

FOREIGN PATENT DOCUMENTS

| | | | |
|---|---|---|---|
| 2609169 | 9/1976 | Fed. Rep. of Germany | 273/142 B |
| 2804089 | 8/1978 | Fed. Rep. of Germany | 273/138 A |
| 1472704 | 5/1977 | United Kingdom | 273/143 R |

*Primary Examiner*—Richard C. Pinkham
*Assistant Examiner*—Scott L. Brown
*Attorney, Agent, or Firm*—Blakely, Sokoloff, Taylor & Zafman

[57] ABSTRACT

In a slot machine, the individual mechanical reels are stopped under the command of an electronic circuit at positions determined by a random count created by the electronic circuit. Specifically, counting registers are continuously cycled through counts corresponding to all possible combinations of the indicia on the reels at a rapid rate while the machine is idle, the cycling being stopped when play begins. The content of the registers at the moment when the cycling is stopped determines the position in which the electronic circuit will stop the reels. The randomness of the count may be increased by cyclically changing the relationship between the counting registers and the reels. The reel positions are delineated by a repeated code providing a different code for any successive three positions. Two sensors are provided to determine the position and detect an error in the stopped position of the reel.

9 Claims, 10 Drawing Figures

REGISTER INTERCHANGING SEGMENT

INDICIA GENERATING SEGMENT

REFERENCE LOCATING SUBROUTINE

REEL STOP SEGMENT

REEL STOP SUBROUTINE

REEL CORRECTION SEGMENT

METHOD AND APPARATUS FOR RANDOMLY POSITIONING INDICA-BEARING MEMBERS

BACKGROUND OF THE INVENTION

Mechanical game machines of the type in which a player spins reels provided with indicia on their perimeter to display a random combination of indicia when the reels stop are well known. They are basically of two kinds: in the purely mechanical type, an analog mechanical timing device with a randomly variable delay stops the reels in random positions; in the electronic type, random numbers are electronically generated by an algorithm using seed numbers, and are translated into an appropriate visual display, usually on a cathode-ray tube screen.

For psychological reasons, probably relating to the feeling of impersonality conveyed by an electronic device as opposed to a mechanical one, electronic game devices of this type have had little success, although the use of devices having an electronically generated randomness is preferable. Electronic devices are not only cheaper to build and maintain, but in a typical mechanical device, the motive power for the timing mechanism is a spring which is cocked by the player. Depending on how fast or how slowly the spring is cocked, the kinetic energy released by it can vary slightly, thus giving the player a small amount of control over the timing mechanism. This factor, as well as the effect of mechanical wear, can make it possible for the odds of any given indicia combination being displayed to vary by as much as several percentage points from the theoretical odds dictated by the distribution of the indicia on the reels.

SUMMARY OF THE INVENTION

The present invention solves this problem by providing a device in which reels are mechanically spun just as in a conventional mechanical device, but in which the stopping position of the reels is controlled by a digital countdown from an electronically randomly generated starting count.

In accordance with a further aspect of the invention, the counting means also perform a monitoring function to ascertain whether the reels are in fact stopping in the position dictated by the countdown, and to provide an output from which the actual reel position and/or any mismatch can be determined.

The invention can be carried out either by electronic hardware, in the form of physical counting and switching circuits, or by a microprocessor program which controls the machine functions in accordance with inputs provided by sensors monitoring the mechanical components of the machine.

In accordance with skill another aspect of the invention applicable particularly but not exclusively to the microprocessor embodiment thereof, the randomness of the count is increased by producing separate counts for each reel, and continuously changing the assignment of any given count to any given reel.

The invention as described herein is particularly applicable to a coin-operated slot machine, but it is equally applicable to non-coin-operated amusement devices with the modifications described.

DETAILED DESCRIPTION OF THE INVENTION

Figure 1:
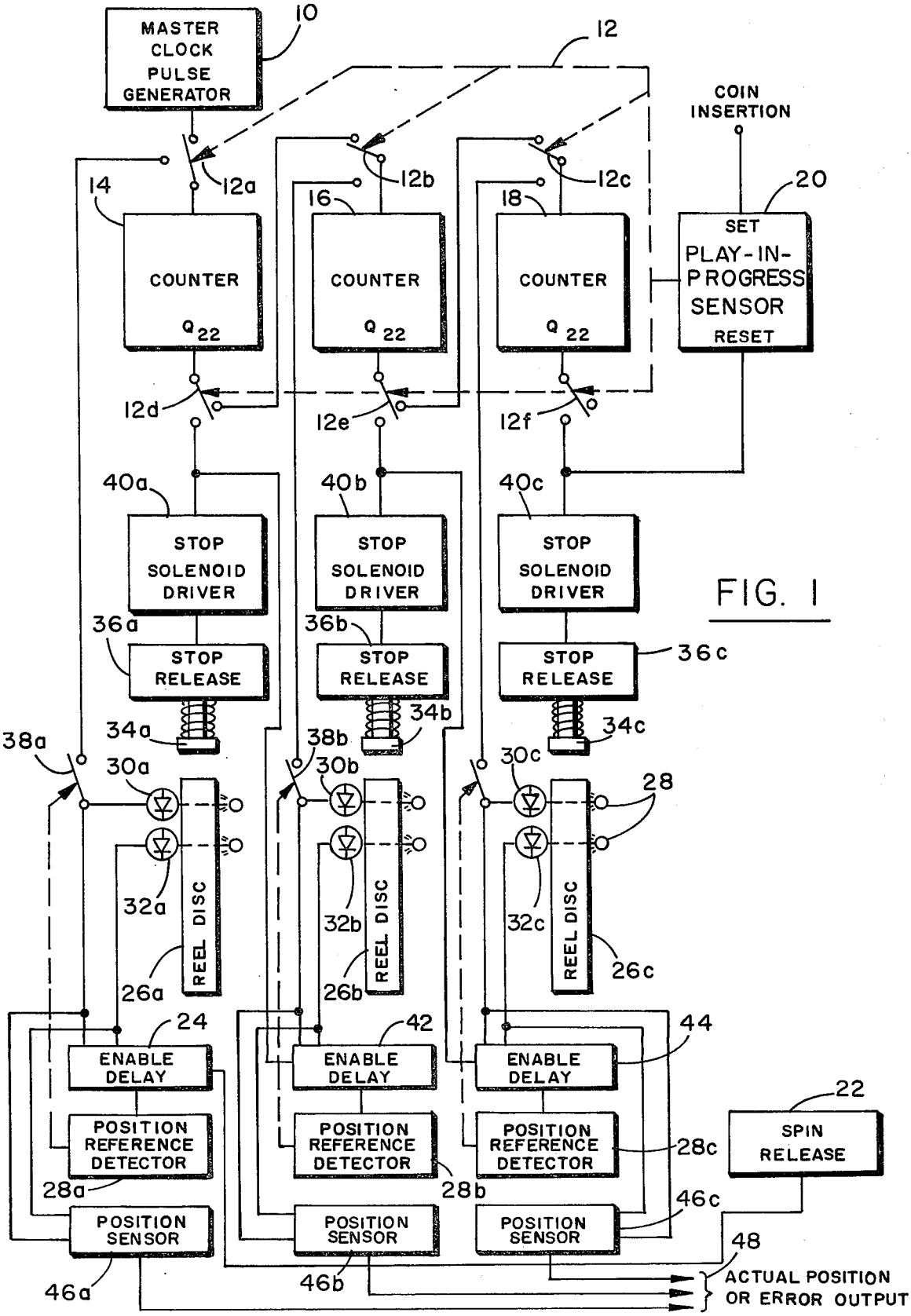
FIG. 1 is a block diagram of the circuit of a hardware embodiment of the invention.

The functioning of the invention is as follows, reference being had to the various figures of the drawing as indicated in the text.

FIG. 1 schematically shows the general functioning of the machine of this invention. In the idle condition of the machine, the master clock pulse generator or oscillator 10 produces clock pulses at a frequency which is not critical but which is preferably chosen to be at least ten times the frequency at which indicia pass the display line of the machine when the reels are spinning. In a typical embodiment of the invention, a master clock frequency of 100 kHz may be used.

In the idle condition of the machine, the switches 12*a* through 12*f* are in the position shown in FIG. 1. It will be understood that the switches 12*a* through 12*f* would in practice be switching transistors controlled by a control signal 12, but they have been shown as physical switches in FIG. 1 for clarity.

With the switches 12*a* through 12*f* in the position shown, the master clock pulses are fed into counter 14. This counter is of the recycling type and may, in a typical embodiment, have 22 steps. Consequently, on a count of 22, counter 14 will produce an output pulse at $Q_{22}$ and return the count to zero. The output pulses at $Q_{22}$ of counter 14 becomes counter 16, which functions in a like manner. The output pulses at $Q_{22}$ of counter 16 in turn become the input pulses for counter 18.

Each of the counters 14, 16, 18 is associated with one of the reels of the game machine, and the number of steps in each counter is equal to the number of indicia on the reel which it is associated.

In a three-reel machine such as shown in FIG. 1, it will take $22\times22\times22$ or 10,648 master clock pulses to cycle all three counters at least once. At a clock frequency of 100 kHz, this takes approximately one-tenth of a second. Consequently, in the several seconds which will elapse between plays in even the fastest use of the machine, all the counters will cycle through their count many times.

The initiation of a play by a player sets a play-in-progress sensor 20. The sensor 20 may typically be a flip-flop circuit which can be set in various ways, depending on the type of machine involved. For example, in a coin-operated machine, the sensor 20 may be actuated by the acceptance of a coin. In a non-coin-operated machine, the play-in-progress sensor 20 might be set by a microswitch actuated when the player moves the handle of the machine out of its rest position and begins to cock the reel-spinning mechanism.

Upon actuation of the play-in-progress sensor 20, switches 12*a* through 12*f* are moved to their other position, and the counters 14, 16, 18 are disconnected from the master pulse generator 10. The counters thus stop in a totally random position depending on the exact number of master clock pulses which have been counted (at the rate of 100,000 per second) since the end of the previous play.

Movement by the player of the handle of the machine toward the fully cocked position eventually trips a spin-release mechanism 22 of conventional design within the machine, and the reels begin to spin. The tripping of the spin-release mechanism 22 may be sensed by a microswitch or other appropriate device (not shown) and is used to start the enable delay circuit 24, whose operation will be described below.

Figure 2:
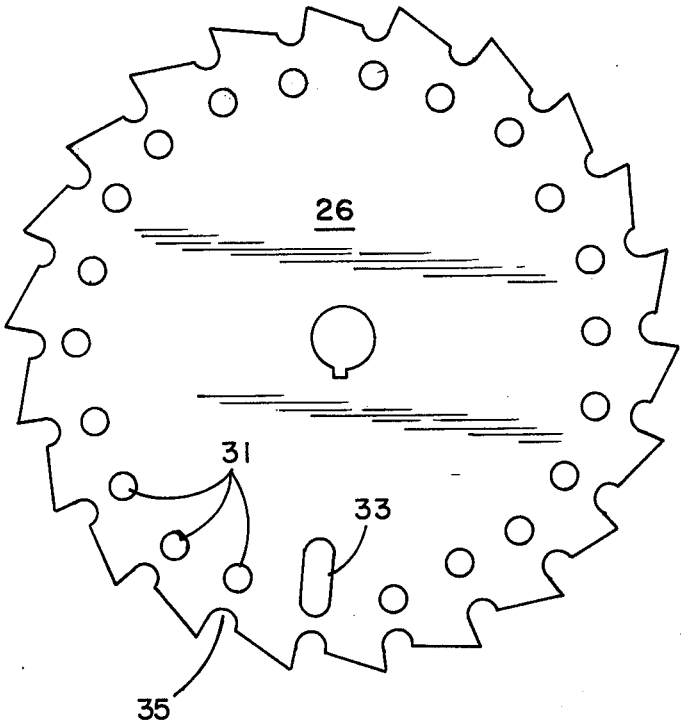
FIG. 2 is a side elevation of the reel disc used in the embodiment of FIG. 1.

The reels are mechanically tied to a reel disc 26 shown in detail in FIG. 2. The reel disc 26 has a pattern of openings through which light beams from light sources 28 can reach photodiodes 30, 32 as the reel disc spins together with the reel to which it is attached. The rim of the reel disc 26 is equipped with notches designed to be engaged by stop dog 34 is released by the stop release 36.

It will be seen in FIG. 1 that a separate reel disc 26*a*, 26*b* and 26*c* is provided for each of the reels of the machine. As the reels spin, the openings in the reel discs 26 cause pulses to be generated by photodiodes 30, 32. The photodiodes 30 are positioned adjacent the row of openings 31 in reel disc 26 in such a manner that they will produce one pulse for each indicia position that passes a photodiode 30. The photodiodes 32 are so positioned that they will produce a pulse only once in each revolution of the disc 26 when the slot 33 passes by them.

After the reels have spun a predetermined length of time, the enable delay circuit 24 times out and connects photodiodes 30*a* and 32*a* to position reference detector 28*a*. The position reference detectors 28 detect the reference pulse from photodiodes 32 as they pass a slot 33, and use this pulse to close switch 38.

With switch 38*a* closed, the pulses produced by photodiode 30*a* are conveyed through switch 12*a* to counter 14. These pulses advance the counter from the count on which it has stopped until it reaches the count which produced an output at $Q_{22}$. The output pulse from $Q_{22}$ of counter 14 is conveyed through switch 12*d* to the stop solenoid driver circuit 40*a* which actuates stop release 36*a* and causes stop dog 34*a* to engage a notch 35 on reel disc 26*a* to stop the first reel.

At the same time, the output pulse from $Q_{22}$ of counter 14 starts enable delay 42 to provide an appropriate time interval before the stop sequence for the second reel is initiated. The stop sequence for the second reel is identical to the one described above, with the position reference detector 28*b* closing switch 38*b* whereupon the pulses from photodiode 30*b* advance the counter 16 until stop solenoid driver 40*b* actuates the stop release 36*b*.

The output pulse at $Q_{22}$ of counter 16 starts enable delay 44, and the process is repeated to stop the third reel associated with reel disc 26*c*.

If it is necessary to produce an electronic output indicative of the position in which the reels have stopped, this cannot reliably be done by counting the pulses of photodiode 30 from the reference point 33, as it is possible that the stop dog 34 may not properly engage the reel disc 26 and may cause the mechanism to jump to a position adjacent to the one that was intended. For this reason, position sensors 46 are provided to compare the output of their associated counter 14, 16, or 18 with the count of their associated photodiode 30 from the reference point. If they fail to match, the true count and/or an error indication may be conveyed to an output 48. The output pulse from $Q_{22}$ of the last counter 18 may be used to reset the play-in-progress sensor 20 so as to restart the random count of master clock pulses from master clock pulse generator 10 for the next play, and to enable the coin acceptor mechanism in a coin-operated machine.

As shown by FIGS. 3 through 10, the method of this invention can be carried out not only by the above-described circuitry, but also by an appropriately programmed microprocessor.

Figure 3:
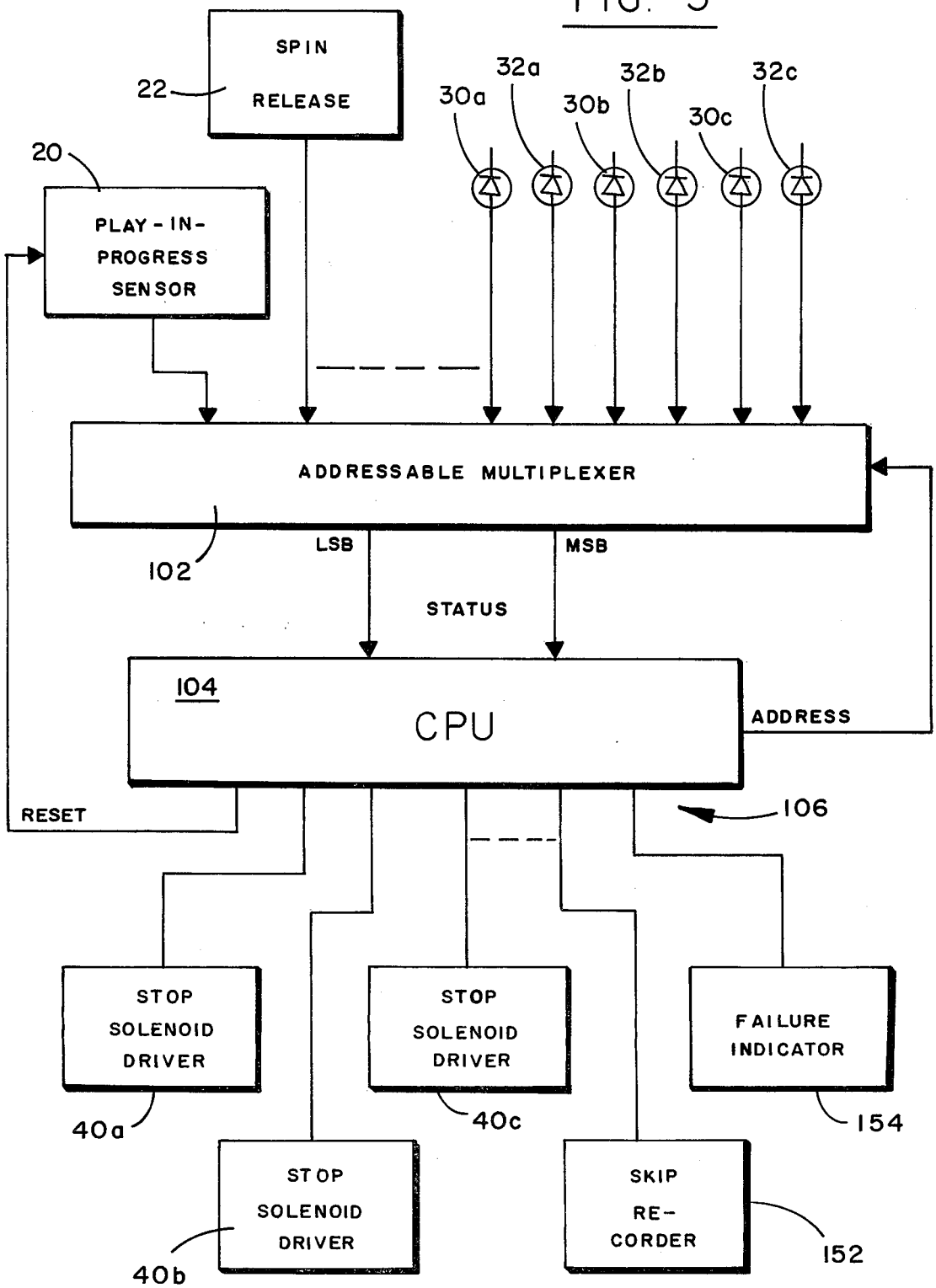
FIG. 3 is a block diagram of a microprocessor embodiment of the invention.

In FIG. 3, a conventional microprocessor 100 is shown as consisting basically of an addressable input multiplexer 102, a central processor unit 104, and outputs 106. The inputs to multiplexer 102 are binary inputs from the machine's play-in-progress sensor 20, reel release 22, and photodiodes 30*a* through 30*c* and 32*a* through 32*c* (FIG. 1). The outputs 106 include outputs to the stop solenoids 40*a* through 40*c* (FIG. 1), as well as to the reset input of the play-in-progress sensor 20. Other inputs and outputs may of course be used in connection with other game functions not material to this invention and, therefore, not described herein.

Figures 4, 5:
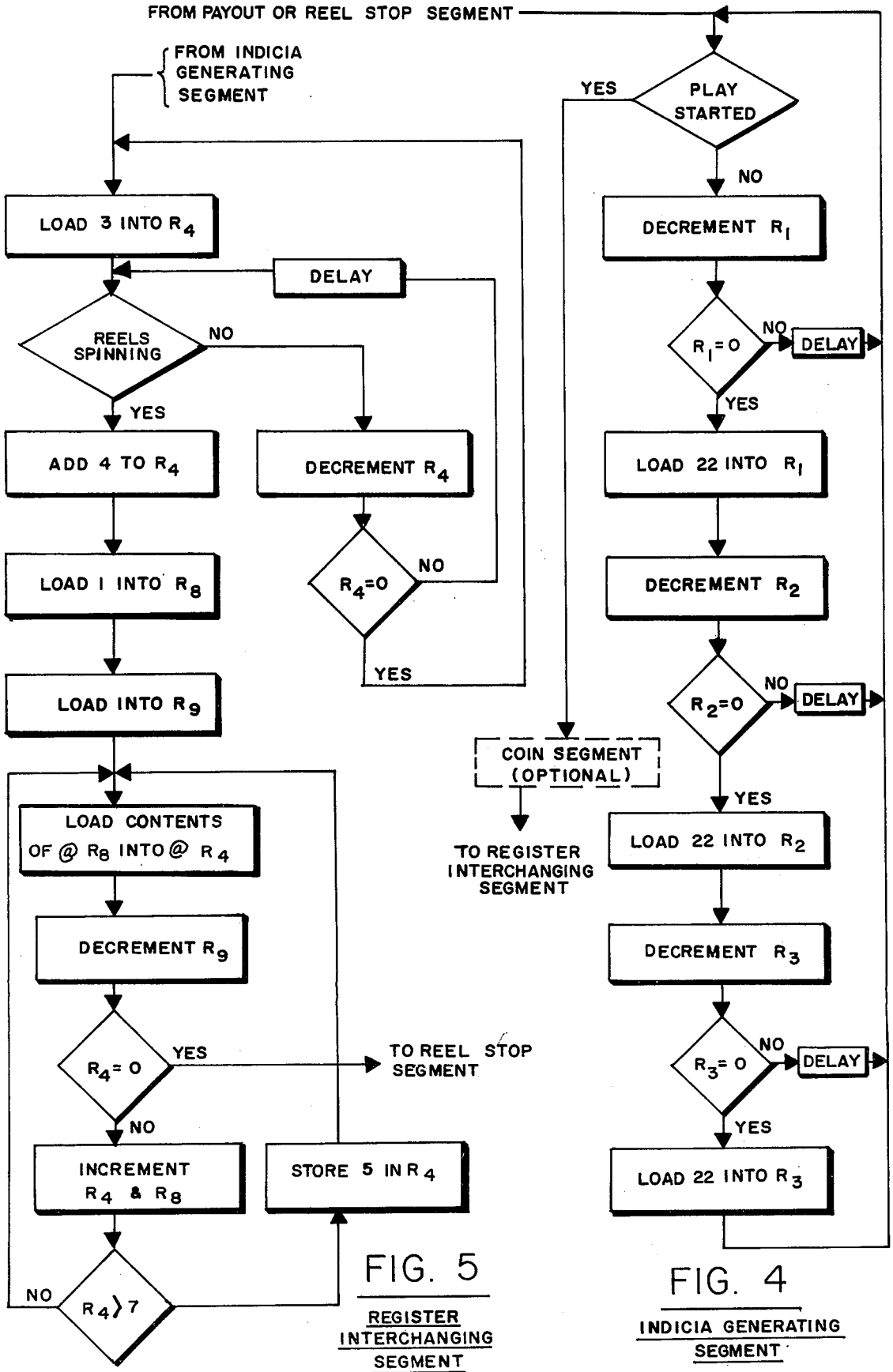
FIG. 4 is a flow diagram of the indicia generating segment of the microprocessor program of FIG. 3.
FIG. 5 is a flow diagram of the register interchanging segment.

The sequence of microprocessor operations of the invention is illustrated in the flow charts of FIGS. 4 through 9. Referring first to FIG. 4, the indicia generation segment of the program is initiated by the end of the previous play and the consequent resetting of the play-in-progress sensor 20. The program starts by addressing the play-in-progress sensor 20 (in a coin-operated machine, this would be the coin acceptor) through the multiplexer 102 and testing its status to determine if a new play has been initiated (e.g. by the acceptance of a coin).

If no new play has yet commenced, the program decrements a storage register $R_1$ in the microprocessor's memory. $R_1$ is then tested for zero. If $R_1$ is nonzero, the cycle is repeated after a short loop delay (preferably obtained by the insertion of an appropriate number of no-operation instructions) which assures that the cycle time from negative branch of the "play started" test back to its input is constant regardless of the path followed.

If $R_1$ is zero, the program loads into $R_1$ the number of indicia per reel (22 in a typical slot machine), decrements a second memory register $R_2$, and tests the latter for zero. The same procedure is used with respect to a third memory register $R_3$ (for a three-reel machine). Additional registers would be used if the machine has more than three reels.

It will be seen that as long as the machine is idle, (i.e. no new play has been initiated), registers $R_1$ through $R_3$ act as a cascade counter. Consequently, each of $R_1$, $R_2$ and $R_3$ contains, at any given moment, a number between 1 and 22. If the microprocessor is, for example, an Intel 8048, it would have a cycle time of 4.19 microseconds per instruction; consequently, regiters $R_1$ through $R_3$ would take approximately 625 milliseconds to run through all 10,648 possible number combinations. As described hereinabove in connection with the hardware embodiment of the invention, this may not be quite fast enough for sufficient randomness; however, the randomness of the program is substantially increased by randomly interchanging the register counts and by starting the count from a random count, both as hereinafter described.

When play is begun (as, for example, by the acceptance of a coin in a coin-operated machine or the pulling of the handle in a non-coin operated machine), the test of the play-in-progress sensor input causes the program to freeze the count in registers $R_1$ through $R_3$ and to divert program execution to the next program segment, which may be a conventional segment commonly used in all electronic machines and designed to control the coin-mechanism and release the handle. It could be omitted in a non-coin-operated machine, in which the program would proceed directly to the register interchanging segment.

Referring now to FIG. 5, the register interchanging segment of the program is entered directly upon completion of the coin segment (in a coin-operated machine) or indicia generation segment (in a non-coin operated machine). It begins by loading a number equal to the number of reels in the machine (3 in the described embodiment) into a memory register $R_4$. The input from spin release is tested again, after a short delay designed to equalize the zero and nonzero loop cycle time. If $R_4$ is zero, the number of reels is again loaded into $R_4$, and the cycle resumes. Thus, in the described embodiment, $R_4$ at any given time contains a number between 1 and 3, cycling through all three combinations approximately every 16 microseconds.

As soon as the handle of the machine has been pulled far enough to wind the reel drive spring and trigger the spin release, the spin release input changes status. The next "reels spinning" test determines that the reels are now spinning and freezes the count in $R_4$.

In order to increase the randomness of the indicia count, the contents of $R_1$ through $R_3$ are to be loaded into memory registers $R_5$ through $R_7$ in a sequence determined by the contents of $R_4$. For this purpose, the number 4 is added to the contents of $R_4$ so that $R_4$ will now contain the address of $R_5$ if it previously contained a 1; the address of $R_6$ if it previously contained at 2; and the address of $R_7$ if previously contained a 3. The number 1 (the address of $R_1$) is now loaded into a memory register $R_8$, and the number 3 (the number of reels) is loaded into a memory register $R_9$.

The contents of the register whose address is in $R_8$ (i.e. the contents of $R_1$) are now loaded into the register whose address is in $R_4$ (i.e. $R_5$, $R_6$, or $R_7$), and register $R_9$ is decremented and tested for zero. If it is nonzero, $R_4$ and $R_8$ are both incremented, and $R_4$ is tested to see if it now contains a number greater than 7 (the address of $R_7$). If it does, the number 5 (i.e. the address of $R_5$) is loaded into $R_4$.

The sequence now returns to the loading of the contents of the register address by $R_8$ (now $R_2$) into the register addressed by $R_4$ (now the next one in line of registers $R_5$, $R_6$, $R_7$). In like manner, the conents of $R_3$ are loaded into the remaining one of registers $R_5$, $R_6$, $R_7$. It will be noted that registers $R_1$, $R_2$ and $R_3$ are not modified by this sequence so that the indicia generation count will resume at the end of the play, at whatever count was in $R_1$, $R_2$ and $R_3$ at the beginning of the play. This makes the indicia generation count more random than in the hardware embodiment of FIGS. 1 and 2, in which the count always starts from zero.

Figure 6:
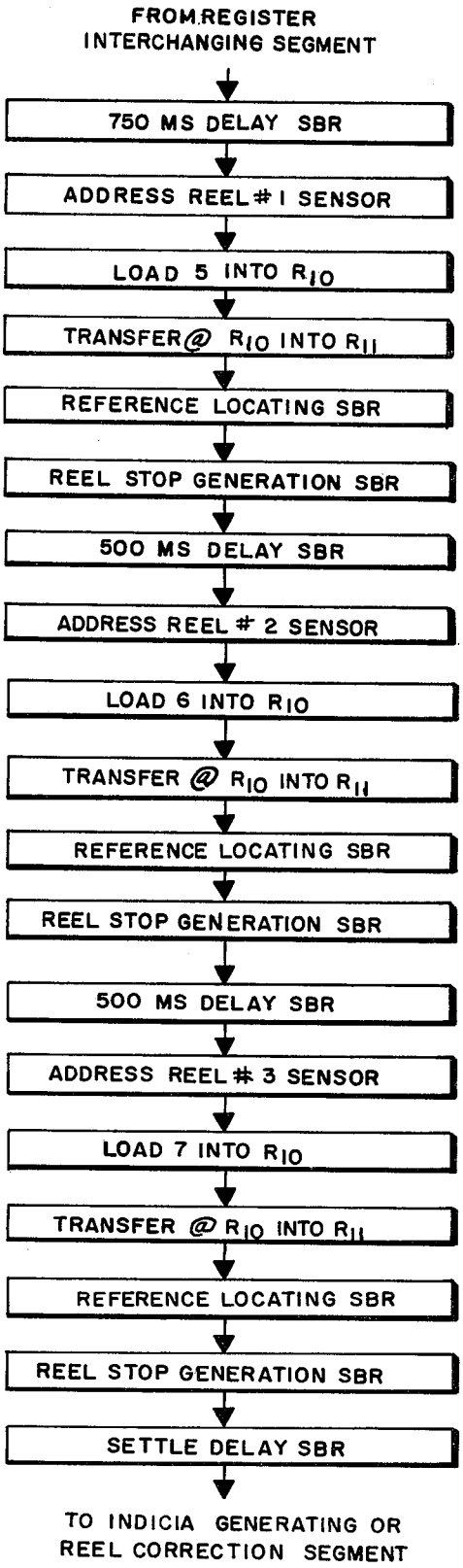
FIG. 6 is a flow diagram of the reel stopping segment.

When $R_3$ has been loaded into the remaining one of registers $R_5$, $R_6$, $R_7$, the next decrementing of $R_9$ zeros it, and the subsequent test of $R_9$ for zero transfers the program to the reel stop segment of FIG. 6.

The reel stop segment begins with an arbitrary delay, shown in FIG. 6 as 750 ms, which represents the length of time for which the first reel is allowed to spin. This time delay can be achieved conventionally by loading a register with a predetermined number and cyclically decrementing it until it reaches zero, the predetermined number being so close that the count-down to zero will require the desired length of time.

Upon the expiration of the delay, the program addresses the input multiplexer 102 (FIG. 3) in such a way that the input to the central processor unit 104 consists of a two-digit binary number whose least significant bit (LSB) is determined by photodiode 30*a* (FIG. 1) and whose most significant bit (MSD) is determined by photodiode 32*a* respectively, associated with the reel disc 126*a* of the first reel.

The number 5 (i.e. the address of $R_5$) is now loaded into a memory register $R_{10}$. The contents of the register addressed by $R_{10}$ (in this instance, $R_5$) are then loaded into another memory register $R_1$. The reference-locating subroutine hereinafter described (FIG. 7) is now called to locate the reference position 125 on the reel disc 126*a* (see FIG. 10), whereupon the reel stop generation subroutine, also hereinafter described (FIG. 8) is called to stop the first reel at a position determined by the contents of $R_1$.

After stopping the first reel, an arbitrary delay (500 ms in the described embodiment) is interposed to allow observation of the first reel by the player before the second reel stops. The input multiplexer 102 is then addressed to read photodiodes 30*b* and 32*b*, the address of $R_6$ is loaded into $R_{10}$, and the program proceeds to stop the second reel in the same manner as described above, based on the contents of $R_6$ which is now in $R_{11}$.

Following the stopping of the third reel in accordance with the signals from photodiodes 30*c* and 32*c*, and the contents of $R_7$ as duplicated in $R_{11}$, a short delay subroutine is called to allow the third reel time to settle. When the reels have settled, the program moves on to the reel correction segment of FIG. 9.

Backtracking now to the reference-locating subroutine of FIG. 7 mentioned above, it works as follows: When called, the subroutine first reads the reel position code (RPC) as determined by the LSB and MSB status inputs from the photodiodes 30, 32, respectively, currently being addressed by the multiplexer 102. By testing this code for zero, the program first locates a sector 120 of reel disc 126 which has no holes. It then reverses the test to find the next sector 122 of disc 126 in which there is at least one hole 131. When the start of a sector 122 is located, a 5 ms delay is interposed to make sure tha no misread can result from a slight misalignment of the two holes in a two-hole sector.

Figure 10:
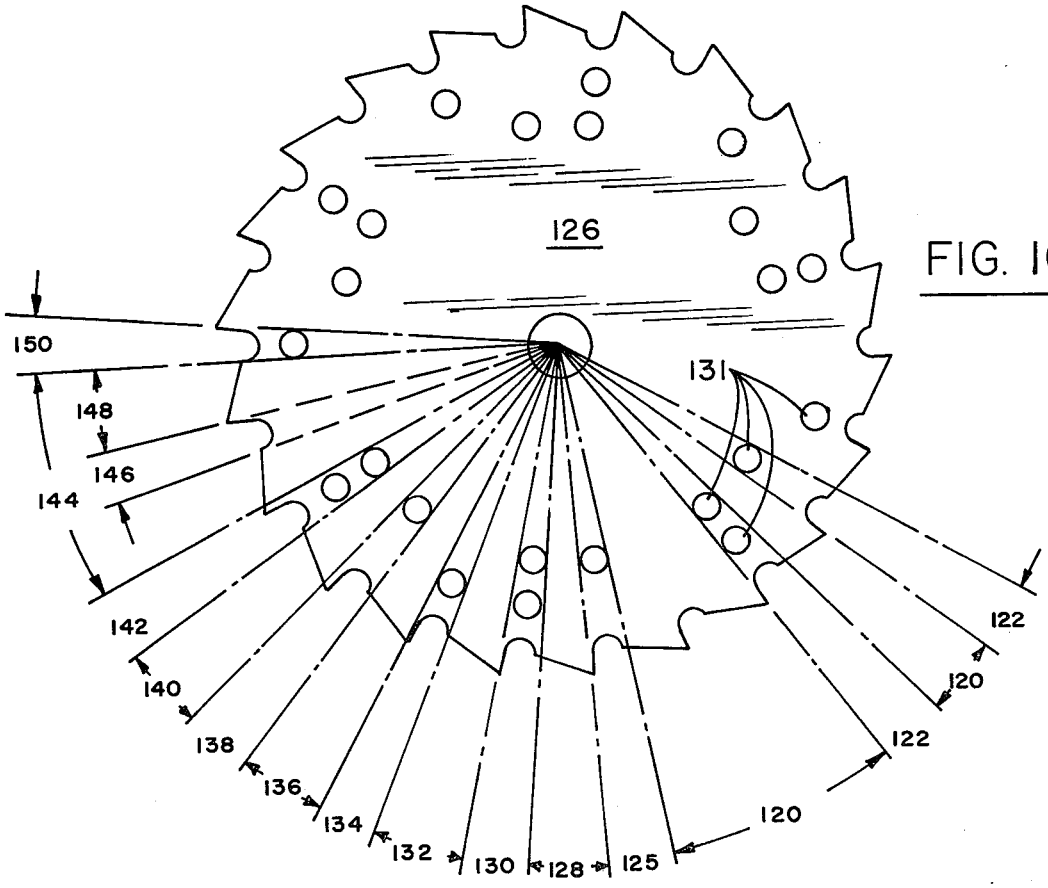
FIG. 10 is a side elevation of the reel disc used in the embodiment of FIGS. 3 through 9.

The RPC is now read again and tested for equality to binary 3 (holes in both the inner and outer rows, FIG. 10). If the test is negative, the section under examination cannot be section 124, and the search for the next section 122 resumes. If the test is positive, the program again looks first for the next section 120, then for the next section with holes 131. When the latter section is located, the RPC is again read and a test for RPC=2 is performed. If that test is negative, the section under examination cannot be section 125, and the original search resumes. If the test is positive, however, the section under examination must be the reference section 125, as this is the only section on disc 126 in which an RPC of 2 follows an RPC of 3 without an intervening RPC of 1.

Having thus located the reference section 125, the program now looks for section 128, then section 130. As soon as the disc 126 reaches section 130, the reference-locating subroutine returns control to the main program in the reel stop segment of FIG. 6.

Figure 7:
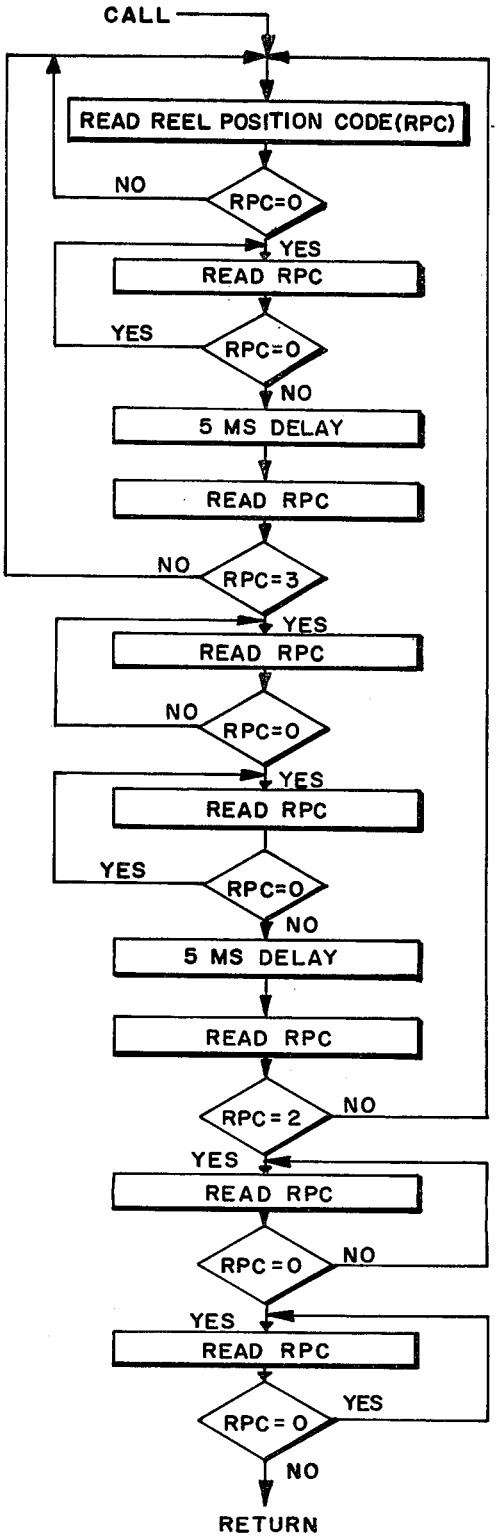
FIG. 7 is a flow diagram of the reference-locating subroutine.
Figure 8:
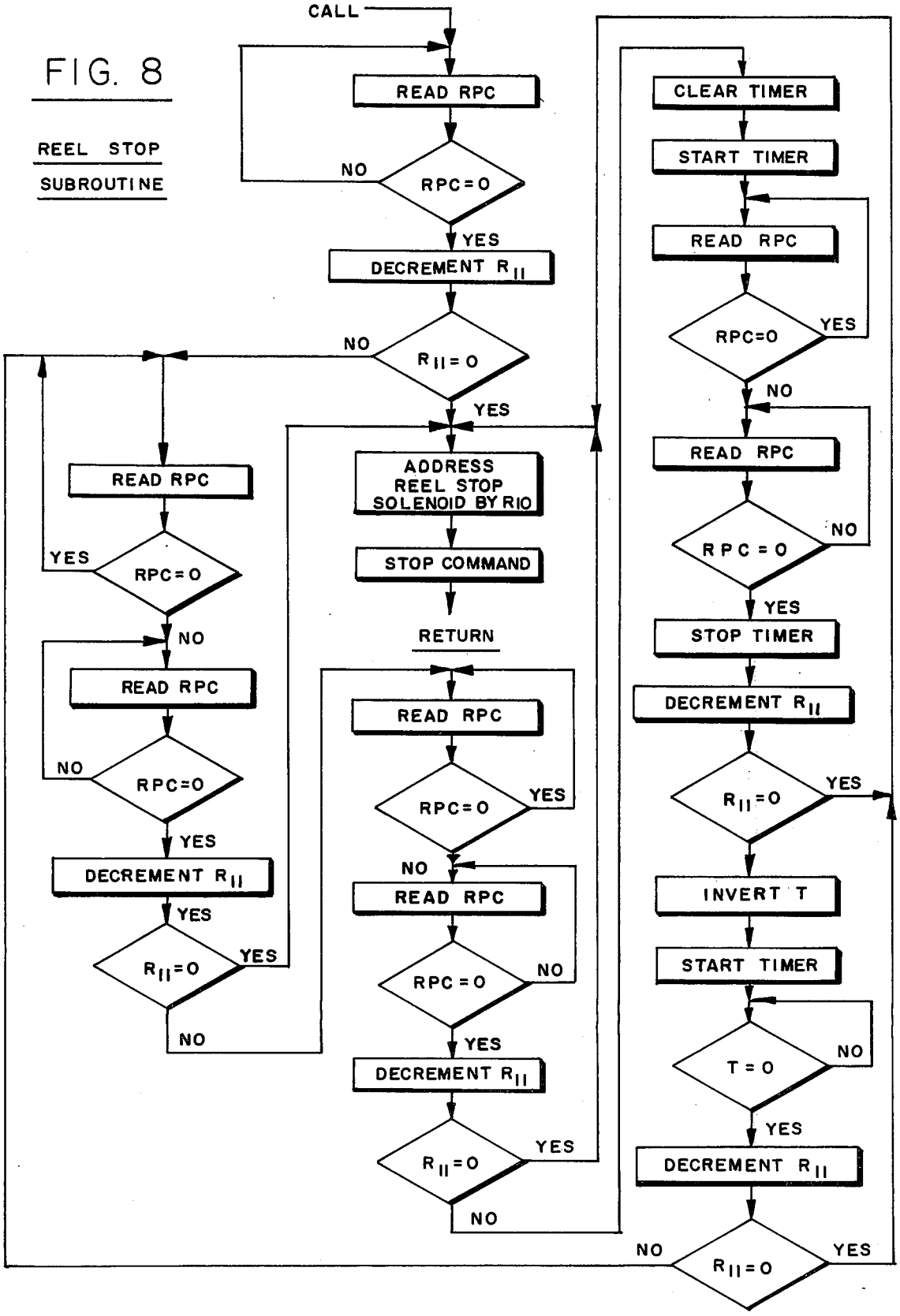
FIG. 8 is a flow diagram of the reel stop subroutine.
Figure 9:
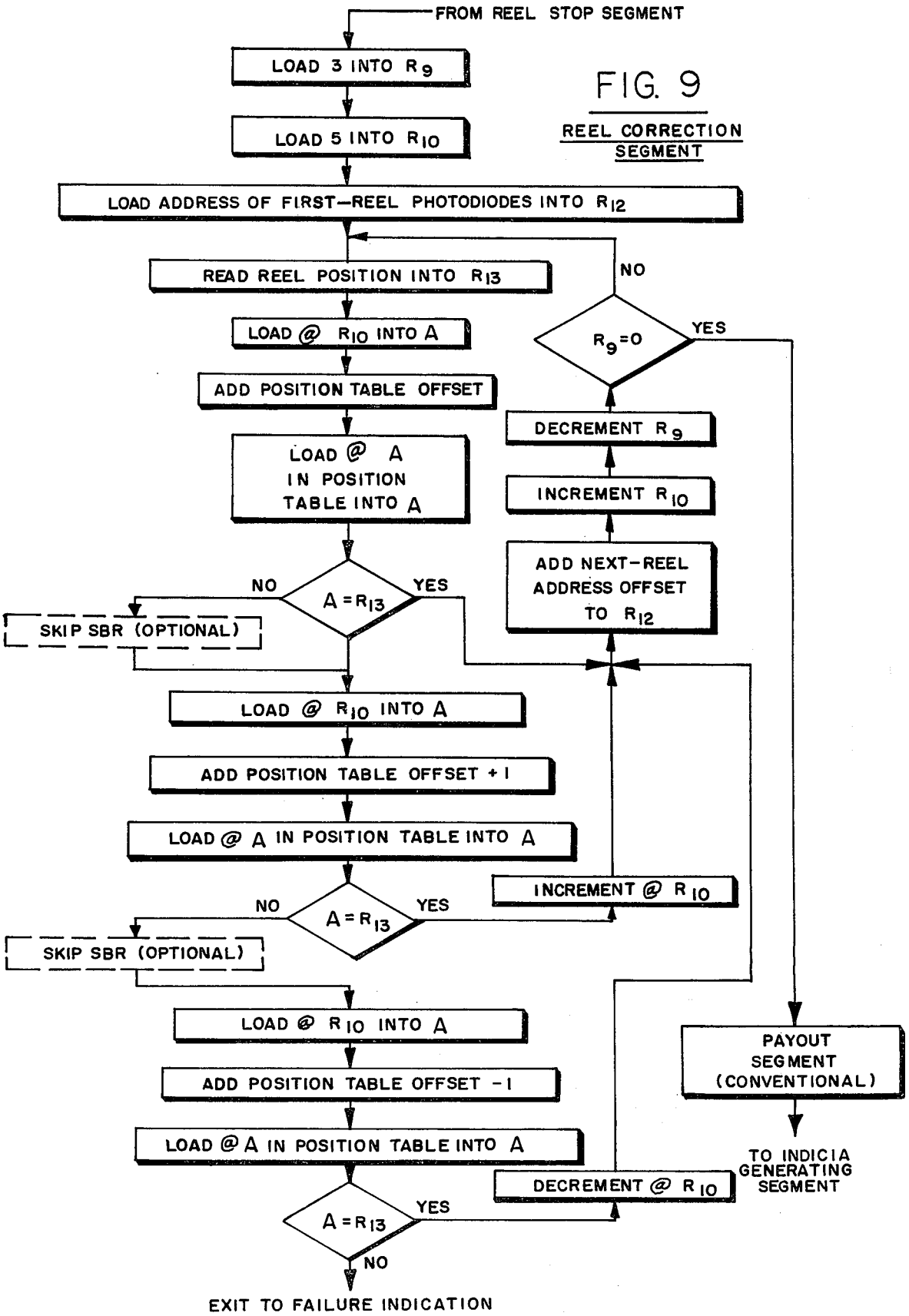
FIG. 9 is a flow diagram of the reel correction segment.

Immediately upon the return from the reference-locating subroutine of FIG. 7, the program calls the reel stop subroutine of FIG. 8. This subroutine begins as the disc 126 enters sector 130, and looks first for sector 132. When a positive RPC=0 test indicates that sector 132 has been reached, the memory register $R_{11}$ (which, it will be recalled, contains a number between 1 and 22) is decremented and tested for zero. If $R_{11}$ is now zero, the contents of $R_{10}$ (which are related to the number of the reel being stopped) are used in an appropriate algorithm to generate the address of the output 106 to which the solenoid driver 40*a*, 40*b*, or 40*c* (FIG. 1) of the reel being stopped is connected. Having generated the proper output address, the program actuates the appropriate trip release 36*a*, 36*b*, or 36*c* through the selected output and driver and stops the reel in sector 134 by engagement of the stop dog 34 with the notch on reel disc 126 (FIG. 10).

If $R_{11}$ is nonzero when tested, the subroutine first searches for sector 134, then sector 136. At the beginning of sector 136, $R_{11}$ is again decremented and tested for zero. If $R_{11}$ tests out zero, the stop release is actuated as described above to stop the reel in sector 138. In like manner, a negative zero-test of $R_{11}$ initiates a search for sectors 138 and 140, where another zero-test of $R_{11}$ triggers the stop sequence, if positive, to stop the reel in sector 142.

It will be noted that the reel stop subroutine does not use the 5 ms delay following a hole detection as the reference-locating subroutine does. The reason for this is that the reel stop subroutine needs to detect only the presence of a nonzero RPC, whereas the reference-locating subroutine also needs to detect the value of the nonzero RPC.

If $R_{11}$ in the last mentioned test is still nonzero, the program clears and then starts the microprocessor's internal timer which, in essence, counts the microprocessor's clock pulses. While the timer is running, the subroutine looks for sector 142, then sector 144. When the beginning of sector 144 is detected, the timer is stopped. The timer register T now contains a number representative of the time it took the reel to move from the beginning of sector 140 to the beginning of sector 144. This is important because the next indicia position sector 146 on the reel disc 126 is part of sector 144 and has an RPC of zero; consequently, the photodiodes 30, 32 are the beginning of sector 146 by a timing operation. Inasmuch as the reels of the machine can (and usually purposely do) spin at different speeds, it is necessary to establish, by the above-described timer count, how long it takes the reel to move from one indicia position sector to the next.

Following the stopping of the timer, $R_{11}$ is again decremented and tested for zero. If it is zero, the stop sequence is initiated, and the reel stops in sector 146. If it is not, the contents of timer register T are inverted and the timer is started, which has the effect of counting time backwards. The timer register T is continually tested for zero, and when the test is positive, the reel will have reached the beginning of sector 148. At that time, $R_{11}$ is again decremented and tested for zero. If it is zero, a reel stop in sector 150 is initiated: if not, the entire above-described sequence is resumed, beginning with the RPC detection following the first test of $R_{11}$ in the reel stop subroutine.

Inasmuch as the mechanical reel stops are subject to wear and bouncing, the reel may, on rare occasions, stop one indicia position short or one indicia position too far. In a coin-operated machine with an automatic payout mechanism, this would result in a false payout evaluation. It is therefore necessary, in the program for such a machine, to provide the reel correction segment illustrated in FIG. 9.

In that segment, the number 3 (i.e. the number of reels in the machine) is first again loaded into $R_9$. The number 5 (i.e. the address of $R_5$) is then loaded into $R_{10}$, and the multiplexer address of first reel photodiodes 30*a*,32*a* is loaded into a memory register $R_{12}$. The multiplexer 102 is then addressed from $R_{12}$,and the RPC of the first reel is read into a memory register $R_{13}$. The contents of the register addressed by $R_{10}$ (i.e. $R_5$) are next loaded into the expected indicia position of the first reel.

A predetermined position table offset constant is now added to register A to create the address of a position table register in an appropriately preprogrammed block of memory. The position table register so addressed contains the RPC which should be seen by the photodiodes 30*a*, 32*a* if the first reel has indeed stopped where it was supposed to.

The expected RPC from the position table register addressed by the accumulator is now loaded into the accumulator and tested for equality to the actual RPC stored in register $R_{13}$. If they are equal, the reel has stopped where it should and no correction is necessary. In that event, an appropriate offset is added to the first-reel photodiode address in $R_{12}$ to create the multiplexer address of the second-reel photodiodes 30*b*, 32*b*.

Register $R_{10}$ is then incremented to contain the address of $R_6$, and $R_9$ is decremented and tested for zero. If $R_9$ is nonzero, the actual RPC of the second reel is now read into $R_{13}$, and the companion cycle is repeated for the second, and eventually, the third reel.

If the equality test of A and $R_{13}$ is negative, a skip has occurred. If it is desired to monitor the occurrence of such malfunctions a skip subroutine (not described in detail) may optionally be used at this point to actuate an appropriate recording device 152 through one of the outputs 106 (FIG. 3).

To determine the direction of the skip, the contents of the register addressed by $R_{10}$ (i.e. $R_5$ for the first reel) are once again loaded into the accumulator register A. This time, however, the predetermined position table offset value plus 1 is added to register A. The subsequent transfer of the position table register contents to A places into A the RPC of the next indicia position beyond the expected one.

When A is now tested for equality to $R_{13}$, a positive test means that the reel has gone one position too far; consequently, the register addressed by $R_{10}$ is incremented to make the expectation conform to reality, and the next reel is checked.

If A and $R_{13}$ are still unequal, the skip must have been rearward, and the above-described procedure is repeated with the predetermined position table offset minus 1. If a renewed test of A and $R_{13}$ for equality is positive, the register addressed by $R_{10}$ is decremented to conform to reality, and the next reel is checked.

If the last-mentioned equality test is still negative, the program diverts to a failure mode routine (not shown)

which halts program execution and, through an appropriate output 106, indicates the need for maintenance by actuating a failure indicator 154 (FIG. 3).

After all the reels have been checked, and any necessary corrections made, the $R_9=0$ test will be positive, and the program exits to a conventional payout segment (not shown). The payout segment is of the type commonly used in all-electronic machines. In essence, it compares the contents of $R_5$, $R_6$ and $R_7$ (which, it will be noted, are now corrected to conform to the actual position of the reels) with a preprogrammed payout table and operates the coint payout mechanism accordingly if the reels have stopped on a winning combination of indicia.

At the end of the payout segment (which includes the conventional housekeeping checks of the machine's mechanisms to ascertain that it is ready for the next play) the play-in-progress sensor is reset through an output 106 (in a coin machine, the coin acceptor is enabled), and the program returns to the indicia-generating segment of FIG. 1, through which it cycles until the next play begins.

I claim:

1. Apparatus for randomly stopping a spinnable inidicia-bearing reel, each indicium on said reel being associated with a specific numerical count and being arranged to periodically pass a reference position, comprising:

(a) means for providing an essentially random number within said numbered count;

(b) reel disc means arranged to spin with said reel, said reel disc means having first and second means thereon associated with said indicia, said first and second means being arranged in a periodically repeated coded pattern with respect to said indicia, said pattern presenting a different code for each indicium in any successive group of three indicia;

(c) means for determining one specific angular position of said indicia-bearing reel;

(d) first and second stationary sensing means adjacent said reel disc means for sensing said first and second means on said reel disc means when each indicium becomes aligned with said reference position and to provide a reel position count responsive thereto and responsive to said means for determining one specific angular position of said reel;

(e) means for stopping said reel when said reel position count corresponds to said random number count; and (f) error detection means coupled to said first and second stationary sensing means to determine whether said reel actually stopped when said reel position count corresponded to said random number count as determined by the code sensed by said first and second sensing means.

2. The apparatus of claim 1 wherein said error detection means also comprises means for determining the actual reel stopping position within one reel count position of said random number count.

3. The apparatus of claim 2 wherein said error detection means also comprises means for providing a corrected random number count in accordance with the actual reel stopping position.

4. The apparatus of claim 3 wherein said means for determining one specific angular position of said indicia-bearing reel comprises a unique code sequence in said coded pattern in a particular section of said reel disc means.

5. A method of randomly stopping a spinnable indicia-bearing reel, each indicium on said reel being associated with a specific numerical count and being arranged to periodically pass a particular position, comprising the steps of:

(a) providing a code comprising a number of code elements associated with the reel, the code having individual code element combinations for each indicium on the reel, said code element combinations being arranged in a pattern which is repeated around the disc, the possible number of code element combinations being less than the number of individual indicium on the reel whereby at least some code element combinations are used more than once;

(b) arranging said code element combinations with respect to the indicium whereby one specific code element combination sequence occurs at only one reference region of the reel, and whereby the code element combinations associated with any at least three successive indicium are different from each other;

(c) sensing said code element combinations as the reel rotates and determining angular position of the reel from the reference region as a result thereof;

(d) initiating an action to stop the reel when the reel angular position corresponds with a predetermined position; and (e) detecting whether the reel actually stopped in said predetermined position by determining whether the code element combination corresponding to the actual stopping position corresponds with the predetermined position.

6. The method of claim 5 further comprised of adjusting the predetermined position by any apparent error detected in step (e) whereby the actual stopping position is determined.

7. The method of claim 6 wherein the number of code elements is two.

8. The method of claim 7 wherein the code elements are detected by photo optical techniques.

9. The method of claim 5 wherein step (c) also comprises determining the rate of rotation of the reel.

* * * * *

UNITED STATES PATENT AND TRADEMARK OFFICE

CERTIFICATE OF CORRECTION

PATENT NO. : 4,421,310

DATED : Dec. 20, 1983

INVENTOR(S) : David E. Williams

It is certified that error appears in the above-identified patent and that said Letters Patent is hereby corrected as shown below:

| COLUMN | LINE | DESCRIPTION |
|---|---|---|
| 1 | [54]<br>3 | In the title after the word "positioning", please delete "INDICA-BEARING MEMBERS" and insert --INDICIA-BEARING MEMBERS--. |

Signed and Sealed this

*Eleventh* Day of *March 1986*

[SEAL]

*Attest:*

DONALD J. QUIGG

*Attesting Officer*

*Commissioner of Patents and Trademarks*